United States Patent [19]

Hörler

[11] Patent Number: 4,752,193

[45] Date of Patent: Jun. 21, 1988

[54] EXHAUST-GAS TURBOCHARGER FOR THE TWO-STAGE SUPERCHARGING OF AN INTERNAL-COMBUSTION ENGINE WITH A DEVICE TO PREVENT LOSSES OF LUBRICANT

[75] Inventor: Hansulrich Hörler, Zurich, Switzerland

[73] Assignee: BBC Brown Boveri Ltd., Baden, Switzerland

[21] Appl. No.: 850,020

[22] Filed: Apr. 10, 1986

Related U.S. Application Data

[62] Division of Ser. No. 640,950, Aug. 15, 1984, abandoned.

[30] Foreign Application Priority Data

Sep. 1, 1983 [CH] Switzerland ..... 4796/83

[51] Int. Cl.[4] ..... F04B 17/00

[52] U.S. Cl. ..... 417/407; 184/6.11

[58] Field of Search ..... 417/405, 406, 407; 60/605, 612; 184/6.11, 103.2

[56] References Cited

U.S. PATENT DOCUMENTS

| | | | |
|---|---|---|---|
| 2,604,188 | 7/1952 | Marchant | 184/6.11 |
| 2,646,212 | 7/1953 | Kellie | 184/103.2 |
| 3,250,068 | 5/1966 | Vulliamy | 60/612 |
| 4,142,608 | 3/1979 | Sarle | 184/6.11 |

FOREIGN PATENT DOCUMENTS

| | | | |
|---|---|---|---|
| 812950 | 9/1951 | Fed. Rep. of Germany | 417/407 |
| 2209909 | 10/1973 | Fed. Rep. of Germany | 417/407 |

*Primary Examiner*—Louis J. Casaregola
*Assistant Examiner*—Timothy S. Thorpe
*Attorney, Agent, or Firm*—Burns, Doane, Swecker & Mathis

[57] ABSTRACT

In order to prevent losses of lubricant in the bearing housing of the high-pressure stage of an exhaust-gas turbocharger for two-stage supercharging, the interior space of the bearing housing is conductively connected via a blocking air ring duct, pipes connected to the latter and a balancing pipe, to the low pressure boost air pipe in front of the high-pressure compressor. An alternate connection between the bearing housing and the low-pressure boost air pipe may be made via an oil return pipe to a lubricating oil tank and a balancing pipe between the lubricating oil tank and the low-pressure boost air pipe.

2 Claims, 3 Drawing Sheets

FIG.1
PRIOR ART
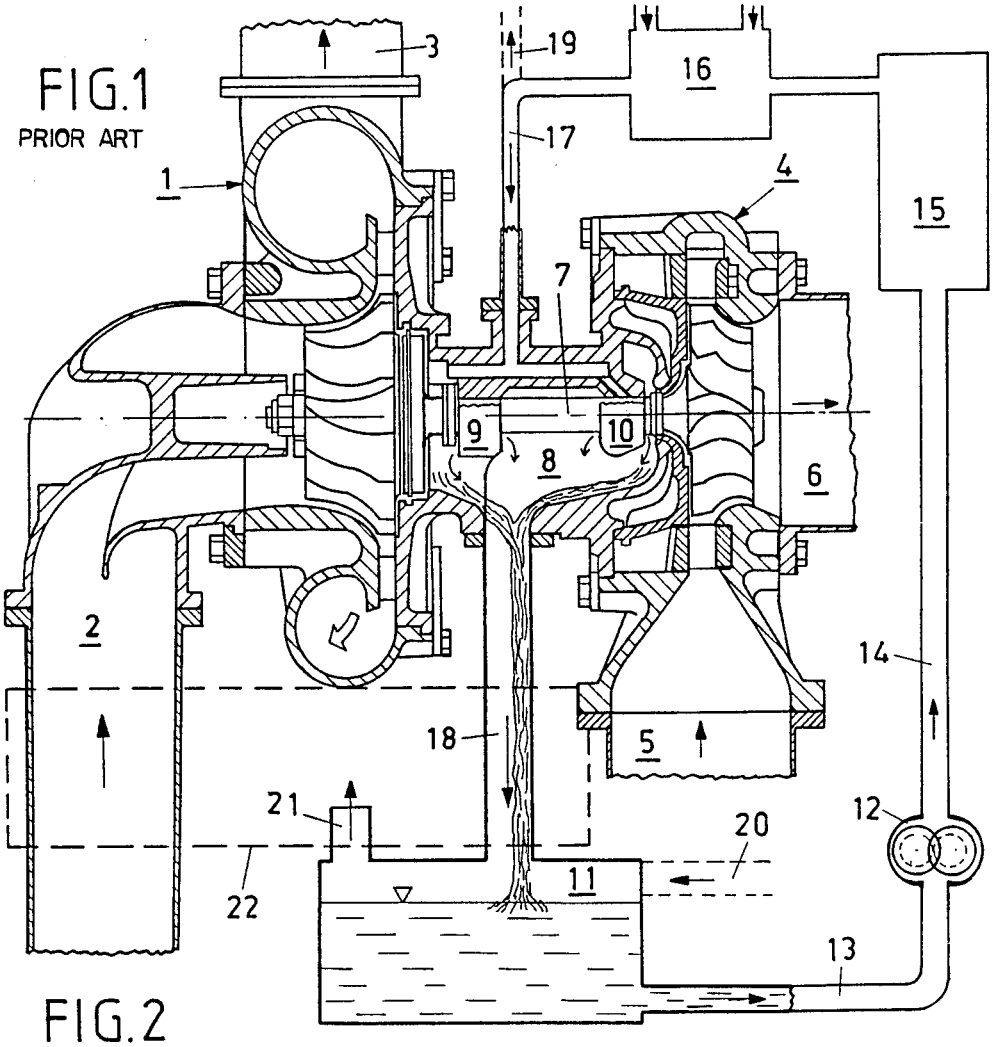
FIG.2
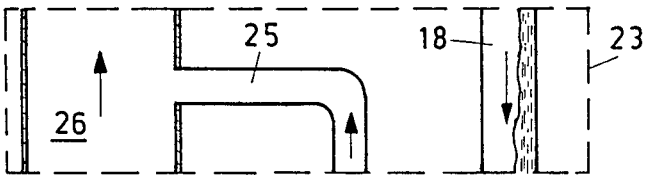
FIG.3
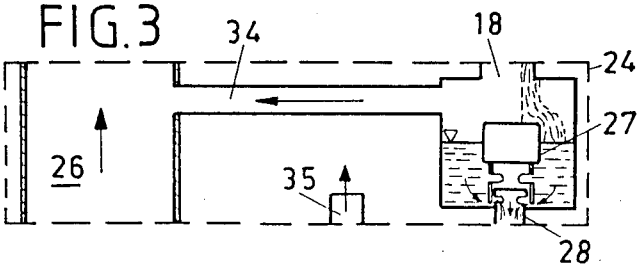
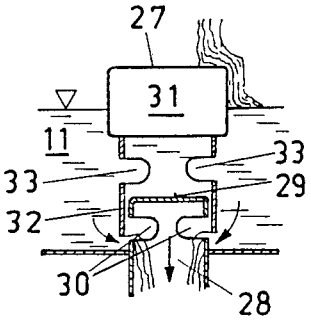
FIG.4

EXHAUST-GAS TURBOCHARGER FOR THE TWO-STAGE SUPERCHARGING OF AN INTERNAL-COMBUSTION ENGINE WITH A DEVICE TO PREVENT LOSSES OF LUBRICANT

This application is a division of application Ser. No. 640,950, filed Aug. 15, 1984 now abandoned.

BACKGROUND OF THE INVENTION

This invention relates to an exhaust-gas turbocharger for the two-stage supercharging of an internal-combustion engine with a construction to prevent losses of lubricant from a bearing housing for the bearings of the compressor and the high-pressure exhaust-gas turbine.

In the case of two-stage supercharging of internal-combustion engines by exhaust-gas turbochargers the bearing of the shaft of the high-pressure stage is frequently arranged in a bearing housing between the turbine wheel and the compressor wheel, while this housing serves as a catching tank for the oil leaving the bearings, out of which it flows back, or is conveyed by a pump, into the oil sump of the engine or into an oil tank separate from the latter. Because it is impossible to seal the above-mentioned housing relative to the compressor housing and the turbine housing so that the entry of oil into them is prevented, the pressure in the bearing housing must always be lower than the pressures in the compressor housing and turbine housing respectively. However, the pressure differential must not be so great as to result in sacrifices of efficiency in compressor and turbine. The pressure in the bearing housing should therefore be only as little as possible below the respectively lower of the pressures in the compressor housing and turbine housing.

As mentioned, the oil which flows out of the bearings into the bearing housing flows from there either into the oil sump of the engine or into an oil tank separate from the latter, while provision must be made for breathing in both cases. The above-mentioned desideratum of the smallest possible pressure differential between the interior of the bearing housing, in which the ambient pressure prevails, and the compressor housing and turbine housing is also dictated by the fact that, in the case of too great a pressure differential, too much air passes into the relevant oil collecting tank and inadmissibly large quantities of oil mist are therefore produced which escape through the oil tank breather and/or crankcase breather into the atmosphere and contribute to environmental pollution.

There is the further consideration that, for small pressure differentials, it is possible to use unsupported ring seals for the sealing means between the bearing housing and the compressor housing and turbine housing; these have a better sealing effect than supported ring seals and are also cheaper.

In the case of single-stage turbochargers, in order to cool the turbine side shaft stub and in order to prevent the entry of exhaust gases into the bearing housing and into the compressor, blocking air is branched out of the boost air pipe and passed through blocking air ducts to the transitional region from the turbine side shaft end to the turbine wheel and escapes into the atmosphere. With this design the labyrinth seal between the compressor housing and the compressor wheel is constructed with such a radius that the axial thrusts acting upon the compressor wheel and the turbine wheel are substantially mutually cancelling. The air behind the labyrinth is likewise discharged into the atmosphere.

Attempts are made by producers of turbochargers to make it possible for such turbocharger types originally designed as single-stage to be used as the high-pressure stage of two-stage turbochargers with the fewest possible modifications. The most important changes and adaptations to the higher pressures in front of the compressor and behind the turbine which are most important for this purpose consist in measures which raise the pressure in the blocking air ducts and in the bearing housing so high that the small pressure differential referred to initially is obtained.

A device is known from the German Utility Design GM No. 80 26 375 of Messrs. Dr. Ing. h.c. F. Porsche AG, whereby losses of lubricant resulting from the causes initially described are intended to be prevented in single-stage turbochargers for spark-ignition engines. For this purpose the air space of an oil tank, in which the oil discharged from the bearing housing is collected and which serves an an air separator is connected to a point of the intake pipe located between a throttle valve and the compressor. Depending upon the position of the throttle valve, which serves as a power regulating element, a higher or lower negative pressure prevails in the admission pipe in front of the compressor, which is transmitted into the oil tank and into the bearing housing, so the emergence of oil from the latter into the compressor housing is prevented, and simultaneously the oil mist formed in the oil tank passes back via the admission pipe and the compressor into the combustion chambers of the engine. Because, due to the negative pressure mentioned, the oil does not flow back spontaneously into the crankcase of the engine, it is necessary to provide a pump which conveys the oil back into the crankcase.

As state, this device is intended for Otto engines which exhibit a throttle flap in the admission pipe in front of the compressor. Single-stage or two-stage turbochargers of diesel engines do not exhibit a throttle flap in the admission pipe, and are therefore not suitable for the system described.

SUMMARY OF THE INVENTION

The inventive aim initially proposed is to be achieved by the present invention, namely for two-stage supercharged diesel engines, where this problem arises in the high-pressure stage, since the prevention of losses of lubricant represents no problem in the case of single-stage exhaust-gas turbochargers of diesel engines due to the pressure conditions in the compressor housing, turbine housing and bearing housing referred to in the introduction.

BRIEF DESCRIPTION OF THE DRAWINGS

The invention is described more fully below with reference to three exemplary embodiments illustrated in the drawing, wherein:

FIG. 1 shows a longitudinal section through a conventional exhaust-gas turbocharger, which it is proposed, by measures according to the invention, to make suitable for use as the high-pressure stage of a two-stage exhaust-gas turbocharger, FIG. 2 shows first means for the modification of the exhaust-gas turbocharger shown in FIG. 1, FIG. 3 shows further means for the modification of the exhaust-gas turbocharger according to FIG. 1, FIG. 4 shows a detail of FIG. 3.

DETAILED DESCRIPTION OF THE PREFERRED EMBODIMENTS

Figure 5:
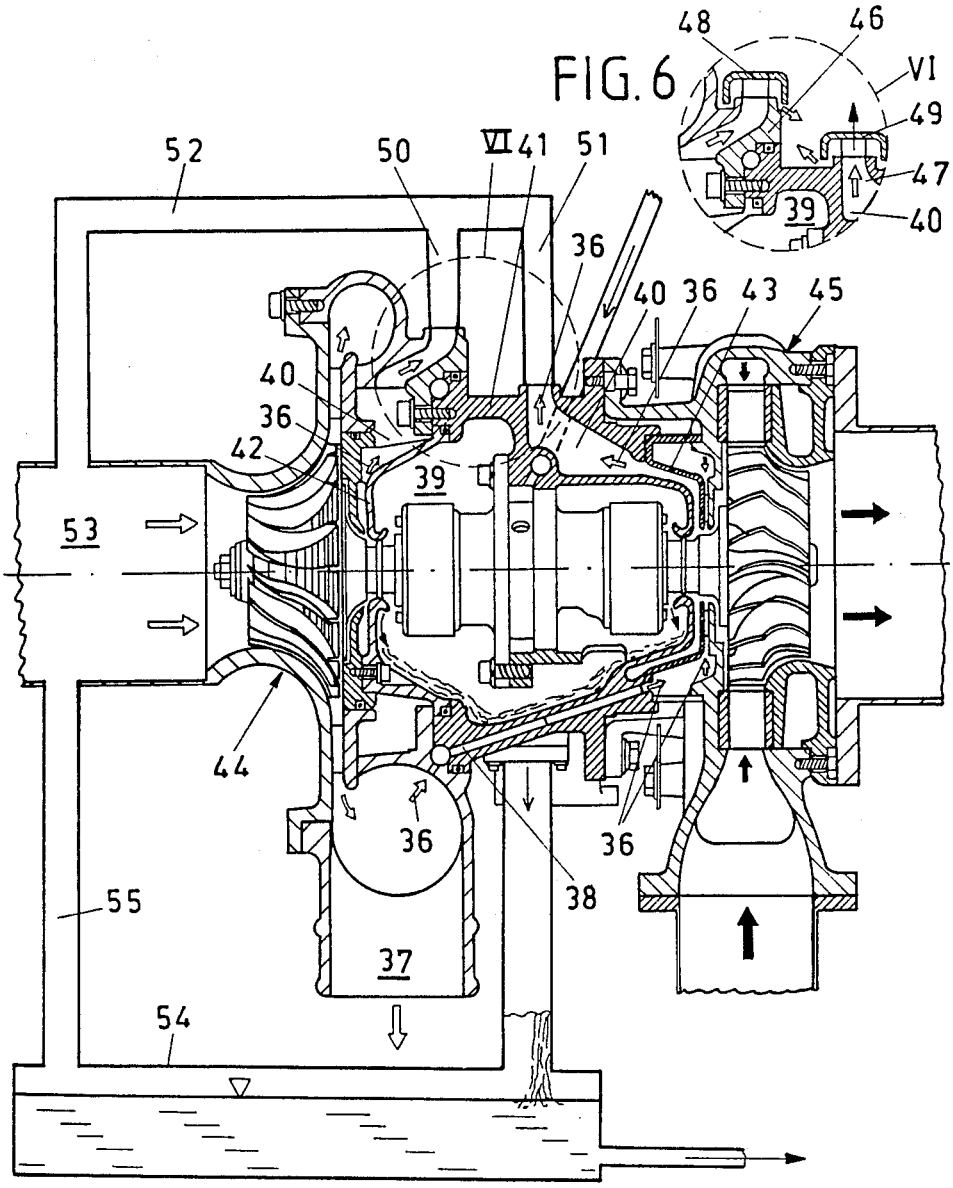
FIG. 5 shows a high-pressure stage of a two-stage exhaust-gas turbocharger with blocking air ducts according to the invention.

The single-stage turbocharger illustrated in FIG. 1 exhibits a compressor 1, which admits atmospheric air through an admission pipe 2, compresses it and conveys it through a boost air pipe 3 into the cylinders of a diesel engine, not shown. The compressor 1 is driven by an exhaust-gas turbine 4 which receives, via an exhaust-gas pipe 5, exhaust gases coming from the engine. The exhaust gas which expands in the turbine 4 passes into the atmosphere through an exhaust pipe 6.

Compressor 1 and turbine 5 are mounted on a common shaft 7, which is mounted in bearings 9 and 10 in the bearing housing 8. The lubricating oil to the bearings 9 and 10 is supplied from a lubricating oil tank 11, from which a lubricating oil pump 12 forces the oil via an oil suction pipe 13 and an oil pressure pipe 14 through an oil filter 15, an oil cooler 16 and a lubricating oil feed pipe 17 into the bearings 9 and 10. The oil which drips out of the bearings collects in the bearing housing 8, from which it flows back through an oil return pipe 18 into the lubricating oil tank 11.

This lubricating oil circuit is valid for large engines with a particular lubricating oil tank provided outside the engine crankcase. In the case of smaller engines the engine lubricating oil present in the crankcase is generally utilised for lubricating the exhaust-gas turbocharger. In this case the pump 12 delivers a part of the oil through an oil feed pipe 19 shown by dash lines branching from the oil feed pipe 17 to the lubrication points of the engine, from which, as symbolised by an oil return pipe 20, it flows back into the crankcase of the engine, symbolised by the oil tank 11.

What has been described so far is an exhaust-gas turbocharger for the single-stage supercharging of an internal-combustion engine, preferably a diesel engine. In this case the breathing of the lubricating oil tank 11 occurs via a breather connector 21 into the atmosphere. A box 22 marked by dash lines accordingly shows the conditions in the region of the lubricating oil return and of the lubricating oil tank breather in the case of single-stage supercharging of an engine.

Two measures which render such an exhaust-gas turbocharger suitable as the high-pressure stage in the case of two-stage supercharging are shown in the boxes 23 and 24 according to FIGS. 2 and 3.

The modification in the box 23, compared to the construction in the box 22, is that the breather connector 21 is conductively connected via a balancing pipe 25 to the low-pressure boost air pipe 26, while the latter is materially identical with the admission pipe 2, but now accommodates the pre-compressed boost air between the low-pressure supercharger, not shown, and the high-pressure supercharger shown above. The higher than atmospheric pressure of the low-pressure boost air pipe 26 therefore also prevails in the oil tank 11, in the oil return pipe 18 and in the bearing housing 8, whereby the pressure differential between bearing housing 8 and the compressor 1, which now supplies the high-pressure supercharging, becomes so small that the initially stated inventive aim, the prevention of losses of lubricant and smallest possible air losses from the high-pressure compressor, is achieved. The pressure differential which the oil pump 12 has to overcome is then the same as when the supercharger is used for single-stage supercharging.

The box 24 shows a device for the situation wherein the lubricating oil circuit of the supercharger is branched from that of the engine, whereby it is not desired for the associated oil tank or the crankcase to be pressurised. This device, shown on a larger scale in FIG. 4, rests on the bottom of an air separator vessel particularly provided for the purpose and includes of a level regulator float 27 in combination with an oil discharge tube 28, the upper end of which is closed by a closure plate 29 and exhibits two slots extending over a large part of the circumference. The float 27 includes of a float vessel 31 and a bell 32 attached to its underside and having slots 33 in the manner of the above-mentioned slots 30 in the oil discharge tube 28. The principle of operation will be clear from FIG. 4. When the lubricating oil level in the tank 11 rises above a specific level, the lower edge of the bell 32 exposes the slots 30 in the discharge tube 28, and oil flows into the crankcase of the engine until the lubricating oil level has fallen back to the lowest level. The oil content separates the crankcase, in which substantially ambient pressure prevails, from the space above the lubricating oil level, which is connected by a balancing pipe 34 to the low-pressure boost air pipe 26, and in which the pressure after the first supercharging stage therefore prevails, as in the bearing housing 8. A breather connector 35 is provided for the breathing of the crankcase.

The high-pressure exhaust-gas turbocharger for two stage supercharging illustrated in FIG. 5 can be obtained by modifications according to the invention from a low-pressure exhaust-gas supercharger with blocking air ducts for single-stage supercharging.

The detail VI framed by dash lines illustrated in FIG. 6 shows the configuration of the supercharger for the single-stage supercharging before the modification. The blocking air symbolized by the small white arrows 36 flows out of the high-pressure boost pipe 37 into a blocking air duct 38, which communicates with a blocking air ring duct 40 surrounding the bearing housing 39. This blocking air ring duct 40 is bounded by an inner envelope forming the bearing housing 39 and an outer housing 41. From this blocking air ring duct 40, transverse walls 42 and 43 demarcate separate chambers which are located between these transverse walls 42, 43 and the compressor 44 and the exhaust-gas turbine 45 respectively, however these chambers are in conductive communication with the blocking air ring duct.

When used for single-stage supercharging, as is clear from FIG. 6, the blocking air ring duct is in conductive communication with the atmosphere via bleed connectors 46 and 47 which are masked by caps 48 and 49.

In the case of the construction modified for high-pressure supercharging according to FIG. 5, these bleed connectors 46 and 47 are conductively connected to the low-pressure boost air duct 53 by pipes 50 and 51 which lead into a common balancing pipe 52, whereby, in the sense of the aim of the invention, such a pressure differential is adjusted between the compressor 44 and the interior of the bearing housing 39 that any emergence of lubricant from the bearing housing into the compressor housing and/or into the turbine housing is prevented.

Figure 5A:
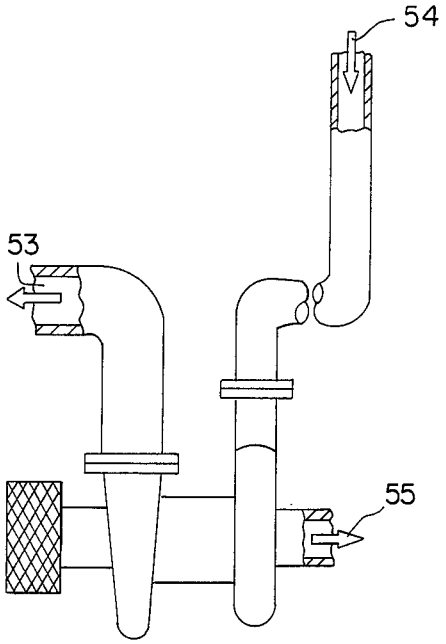
FIG. 5A shows a low pressure turbocharger utilized in combination with the exhaust-gas turbocharger and, FIG. 6 shows how the detail designated VI in FIG. 5 is conformed in the case of an unmodified turbocharger.

In addition, the interior of the lubicating oil tank 54 may also, as in the variants according to FIGS. 2 and 3, be connected by a balancing pipe 55 to a low-pressure boost air pipe 53, whereby the problem of tank breathing is also solved. A low pressure turbocharger is shown in FIG. 5A. Therein, reference numeral 53 indicates the connection of the low pressure turbocharger with the suction side of the compressor of the high pressure stage. Reference numerals 54A and 55A show the connection with the turbine outlet side of the high temperature stage.

Instead of connecting the bearing housings 8 and 39, in the embodiments according to FIGS. 2 and 3 and according to FIG. 5 respectively, to the relevant low-pressure boost air pipes 26 and 53 respectively, they may also be connected to the exhaust-gas pipe between the exhaust-gas turbine of the high-pressure stage and that of the low-pressure stage. Because the pressures in the former exhaust-gas pipe and in the low-pressure boost air pipe are of similar magnitude, but may differ substantially according to the service state and specific application, all the balancing pipes should be connected only to the one or other of the two pipes, namely preferably to the low-pressure boost air pipe, in order that a loss of oil on the compressor side is prevented in all service states, or a contamination of the compressor wheel by exhaust gases from the turbine when idling.

Due to the breathing of the lubricating oil tanks 11 and 54 into the relevant low-pressure boost air pipe 26 or 55 respectively instead of into the atmosphere, the tanks are subject to the same pressure as the low-pressure boost air pipes, so that the pressure differential to be overcome by the oil pump is the same as when the exhaust-gas turbocharger is used for a single-stage supercharging.

I claim:

1. An exhaust gas turbocharger for the two-stage supercharging of an internal combustion engine comprising a low-pressure exhaust gas turbocharger, a high pressure exhaust gas turbocharger and a device to prevent loss of lubricants, the high-pressure exhaust gas turbocharger and the low-pressure exhaust gas turbocharger including compressors connected with each other by a low pressure charging air line, a compressor housing, an exhaust gas turbine, a turbine housing, a housing for bearings of the compressor and exhaust gas turbine, an oil collecting means, means for limiting the escape to atmosphere of oil mist formed in the oil collecting means, said means for limiting including the low-pressure charging air line communicating with said oil collecting means, a means for delivering oil from the oil collecting means to the bearing housing, the bearing housing positioned between the high-pressure exhaust gas turbine and the high pressure compressor, the bearing housing connected by an oil return line with the lubricating oil collecting means and the low pressure charging air line, said oil return line being a conducting connection between the oil collecting means and an inner space of the bearing housing, an equalizing line between the oil collecting means and the lower pressure charging air lines; the bearing housing surrounded by an outer housing spaced from the bearing housing, the space between the bearing housing and the outer housing defining an annular air barrier channel therebetween, the channel connected to the high-pressure compressor to receive leakage air from the high pressure compressor, vent means for connecting the low pressure charging air line and the equalizing line to the channel, and means for maintaining a minimal pressure difference between the bearing housing and the compressor and turbine, said means for maintaining including a blocking air duct communicating with a blocking air ring surrounding said bearing housing.

2. The exhaust gas turbocharger of claim 1, wherein a level control device is provided in the oil collecting means, the device comprising a float bowl, a bell element and a plurality of slots, an oil drain pipe located in the oil collecting means, and the float bowl positioned over the oil drain pipe and being movable with respect to the oil drain pipe to control oil drainage through said oil drain pipe.

* * * * *